US010279276B2

(12) United States Patent
Geery

(10) Patent No.: US 10,279,276 B2
(45) Date of Patent: May 7, 2019

(54) SUBMERSIBLE GLIDING TOY

(71) Applicant: Daniel J. Geery, Salt Lake City, UT (US)

(72) Inventor: Daniel J. Geery, Salt Lake City, UT (US)

(73) Assignee: Daniel J. Geery, Salt Lake City, UT (US)

( * ) Notice: Subject to any disclaimer, the term of this patent is extended or adjusted under 35 U.S.C. 154(b) by 0 days.

(21) Appl. No.: 15/643,260

(22) Filed: Jul. 6, 2017

(65) Prior Publication Data

US 2019/0009182 A1 Jan. 10, 2019

(51) Int. Cl.

| | |
|---|---|
| ***A63H 23/00*** | (2006.01) |
| ***A63H 23/10*** | (2006.01) |
| ***A63H 27/00*** | (2006.01) |
| ***A63H 29/14*** | (2006.01) |

(52) U.S. Cl.

CPC ..... *A63H 23/10* (2013.01); *A63H 27/00* (2013.01); *A63H 29/14* (2013.01)

(58) Field of Classification Search

CPC ..... A63H 23/00; A63H 23/10; A63H 27/00
USPC ..... 446/61, 153, 161
See application file for complete search history.

(56) References Cited

U.S. PATENT DOCUMENTS

| | | | | |
|---|---|---|---|---|
| 43,449 A | | 7/1864 | Andrews | |
| 2,854,787 A | * | 10/1958 | Oberg | A63H 23/10 440/15 |
| 3,835,581 A | * | 9/1974 | Grieder | A63H 23/10 446/158 |
| 4,436,571 A | | 3/1984 | Nakanishi | |
| 5,090,636 A | * | 2/1992 | Sadowski | B64C 39/10 244/16 |
| 5,344,357 A | * | 9/1994 | Lyczek | A63H 23/10 446/154 |
| 5,496,202 A | * | 3/1996 | Pons | A63H 27/00 446/64 |
| 6,328,622 B1 | * | 12/2001 | Geery | A63H 23/10 114/332 |
| D469,144 S | * | 1/2003 | Greenberg | D21/597 |
| 7,052,357 B2 | * | 5/2006 | Silverglate | A63H 23/12 446/153 |
| 7,121,506 B2 | * | 10/2006 | Clancy | A63H 27/02 244/99.2 |
| 7,247,077 B1 | * | 7/2007 | Arias | A63H 23/005 273/350 |
| 8,052,501 B1 | * | 11/2011 | Friend | A63H 23/10 446/153 |
| 8,322,296 B2 | * | 12/2012 | Tiraby | B63G 8/001 114/337 |

(Continued)

*Primary Examiner* — Alexander R Niconovich
(74) *Attorney, Agent, or Firm* — Durham Jones & Pinegar, P.C., Intellectual Property Law Group

(57) ABSTRACT

The system is a type of gliding device capable of gliding through different mediums, such as water. The body of the gliding device is comprised of buoyant material and is ideally chosen based on the best material to utilize the hydrographic printing process. The body encourages the system to rise in water and wings extend from the body and resist vertical motion providing little resistance to forward motion. A third wing may extend from the distal end of the body and have a rudder pivotably connected thereto, allowing a user to manipulate the flight path of the system through the water while the system slowly rises to the surface.

20 Claims, 6 Drawing Sheets

(56) References Cited

U.S. PATENT DOCUMENTS

| | | | | |
|---|---|---|---|---|
| 8,894,460 | B1 * | 11/2014 | Thompson | A63H 23/10 446/153 |
| 9,149,731 | B2 * | 10/2015 | Mimlitch, III | A63H 23/04 |
| 9,352,239 | B2 * | 5/2016 | Hohns | A63H 3/26 |
| 9,616,983 | B2 * | 4/2017 | Mimlitch, III | A63H 23/04 |
| 9,645,181 | B2 * | 5/2017 | Mimlitch, III | G01R 27/02 |
| 2010/0144233 | A1 * | 6/2010 | Scarborough | A63H 27/00 446/46 |
| 2013/0017754 | A1 * | 1/2013 | Lu | A63H 33/26 446/158 |

* cited by examiner

SUBMERSIBLE GLIDING TOY

TECHNICAL FIELD

This disclosure relates generally to printing of graphics on a submersible device, or toy, capable of gliding underwater without propulsion, air or other means. The graphics are intended to be un-removable and stay on the device even though placed in wet environments. The body and wings of the device provide opposing forces to allow the device to rise in water while the wings provide vertical resistance thus forcing the device to glide through the water at a high rate in a forward direction until the device rises to the surface.

BACKGROUND

A few patent references known in the art discussing some of the basic concepts utilized by the present device appears to be in U.S. Pat. No. 6,328,622 as well as U.S. Pat. No. 43,449 obtained by Dr. Solomon Andrews, in 1864, describing "a mode by which the air may be navigated, and a new and useful machine by which it may be done." With regard to the present disclosure relating to a printing process is disclosed in U.S. Pat. No. 4,436,571 obtained by Motoyasu Nakanishi.

Nakanishi observed that "printing" on a three dimensional device could be done by floating a transcription film on liquid and an article is immersed in the printed liquid and the film is transferred to the article.

Andrews observed that a plank rising in water does not rise vertically, but shoots off at a sidewise angle; and he developed an airship that did the same. By valving the hydrogen lifting gas, Andrews was able to glide laterally back down to earth; by thrusting ballast overboard, he could rise up again, much as balloonists still do, but all the while gliding up or down at some oblique angle.

A simple illustration of the fundamental principle can be produced by releasing a wooden yardstick underwater in a flat position, with a slight rise from horizontal. Upon release, the yardstick will shoot out laterally, even though it will thereafter equilibrate and, if the depth be great enough, reverse direction and begin ascending in the opposite direction.

Dr. Andrews' primary claim deals with: "the conversion to the perpendicular motion of a balloon or aerostat into a forward or horizontal motion, by means of the construction or form thereof, so as to make it ascend and descend on inclined planes in the atmosphere."

Thus, it would be desirable to provide a means for converting perpendicular motion into lateral motion, particularly in a submersible underwater vehicle. Such a device would be particularly enjoyable to utilize in swimming pools and other bodies of water which are used for recreation where people engage in water sports or other activities. Specialized and customizable graphics may also be enjoyable for those who wish to personalize the device. Likewise a specific graphic may make the device more easily identifiable and easier to track and follow. In addition, eye-catching graphics and many other graphic possibilities thereof are likely to enhance salability of the device or toy.

On a separate note, it may be desirable to provide a means for the device to bend, curve or glide in a circular or patterned fashion rather than only a straight or linear trajectory. The present device can be formed from off-the-shelf materials. In addition to use as a toy, the present invention may also play a significant role in oceanic research and protection.

DETAILED DESCRIPTION

It will be appreciated that the present device is an improvement upon the Submersible Water Toy as described in U.S. Pat. No. 6,328,622 (the "'622 patent") which is incorporated herein, in its entirety, by reference.

Figure 1:
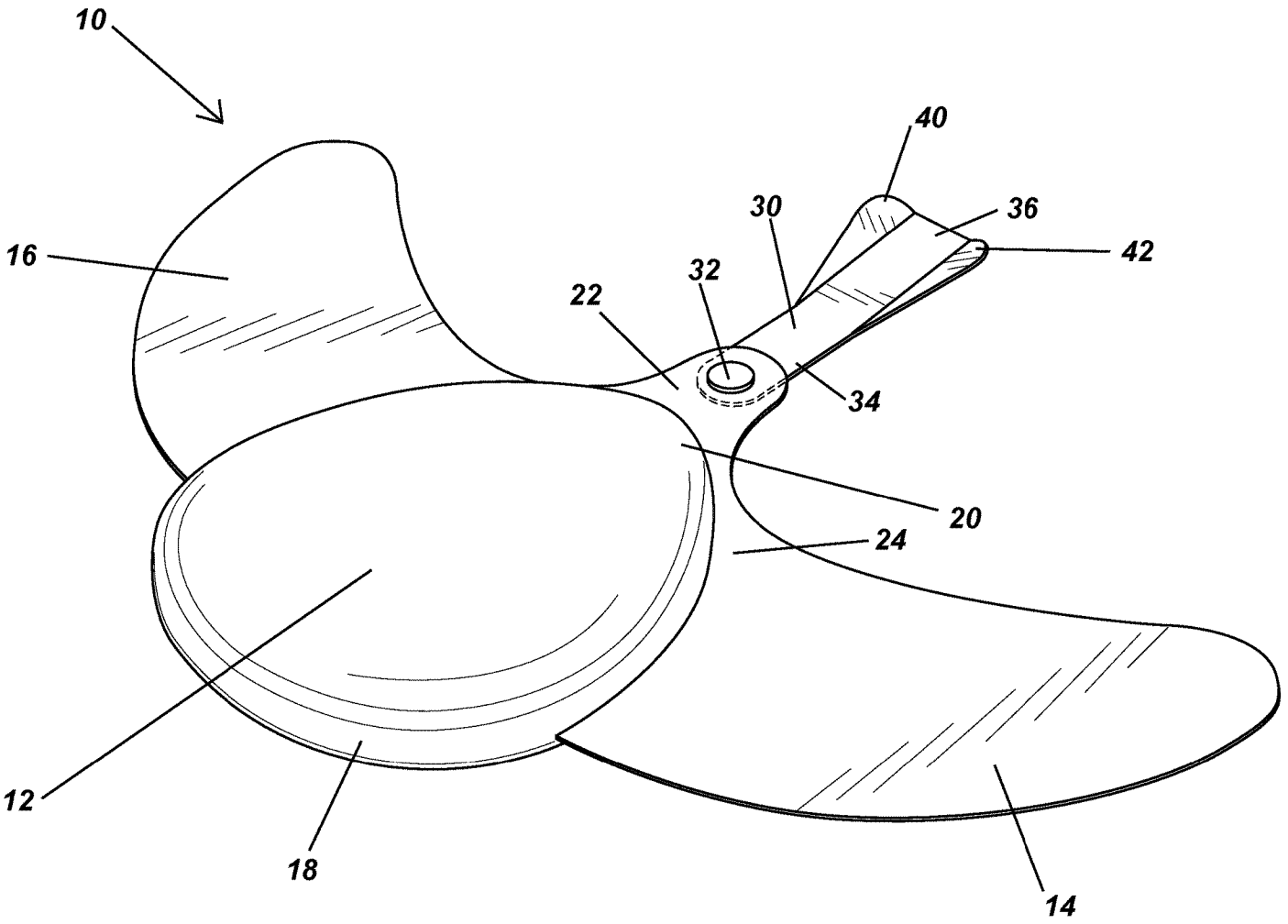
FIG. 1 illustrates a perspective view of the system or device with a body, wing assembly, and rudder.

As seen in FIG. 1, the device 10 includes the same or similar features to those outlined in the '622 patent with a body 12, a first wing 14 and a second wing 16. The body 12 may be tear-drop or guitar pick shaped, or approximately a Reuleaux triangle, with the front end 18 being generally wider than the back end 20. The first wing 14 and second wing 16 may include flat top and bottom surfaces with beveled edges around the perimeter of the wings 14, 16. While the wings 14, 16 generally define flat surfaces, the body 12 may have a generally elliptical cross-section. The wings 14, 16 may extend laterally from the body 12 of the device and may be positioned more toward the back end 20 of the body 12. The wings 14, 16 lie in the same plane as a midline of the body 12.

Figure 11:
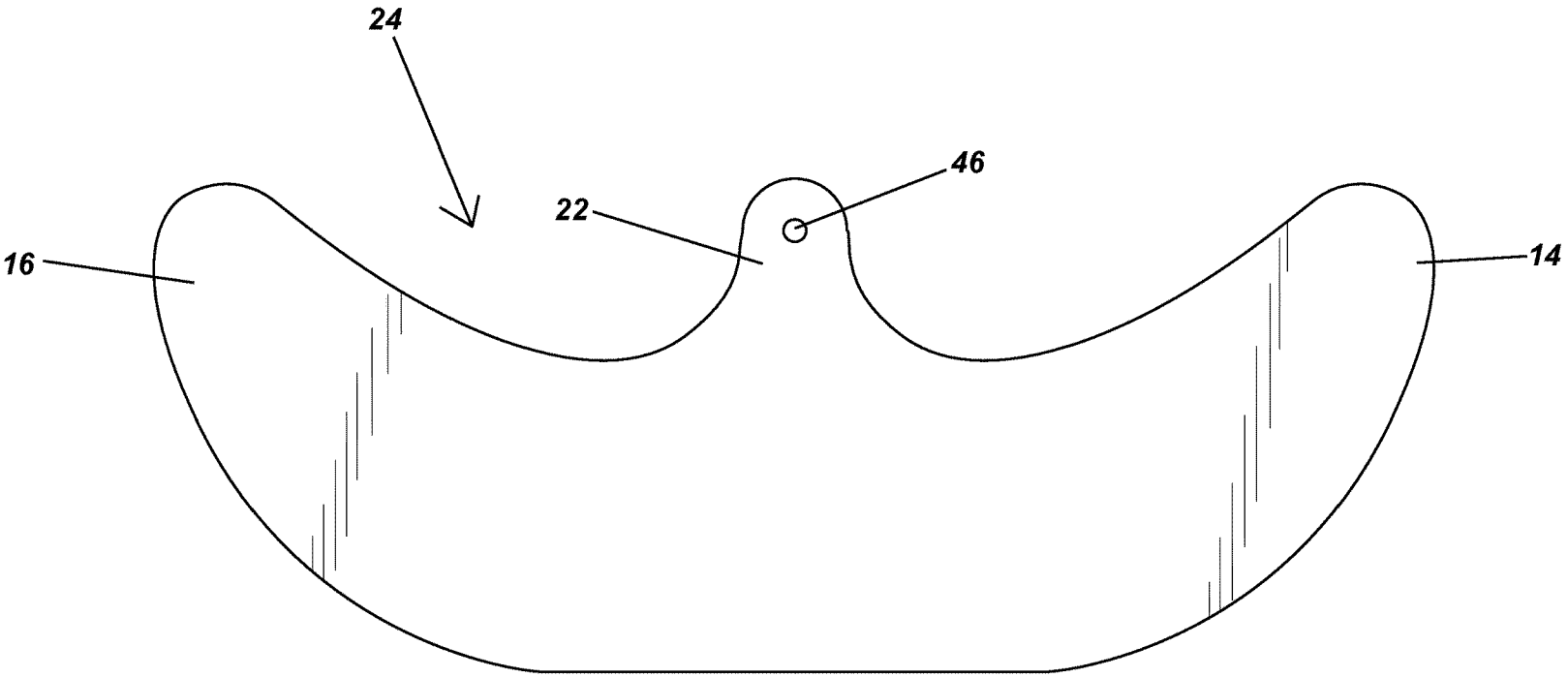
FIG. 11 illustrates one configuration of a wing assembly.

A protrusion, or third wing, 22 may extend from the back end 20 of the body 12 of the device 10. The protrusion 22 may also extend from the wings 14, 16 depending on the configuration (as described in more detail below). The protrusion may be comprised of the same material as the wings 14, 16 which allow it to flex without folding and may be generally flat like the wings 14, 16. The protrusion 22 may extend from the back end 20 of the body a reasonable distance, and in various configurations may be shorter or longer depending on the desired results. In some configurations, the protrusion 22 and wings 14, 16 may be machined or cut from a single piece of material, and form a wing assembly 24. As can be seen in the top view of the device 10 shown in FIG. 2, the first wing 14, second wing 16, and third wing 22, are formed as a single wing assembly 24. (See also FIG. 11 showing a top view of the wing assembly 24 comprising the first wing 14, second wing 16, and third wing 22 formed from a single piece of material).

In other configurations the protrusion or third wing 22 may also be a single stand-alone "wing" that extends from the back end of the body 12. The protrusion or third wing 22 may then be secured in a like manner as previously described herein whether as part of the wing assembly 24 or as a stand-alone piece. Forming the wing assembly 24 from a single piece may simplify manufacturing and may add more rigidity to the device 10.

Figure 2:
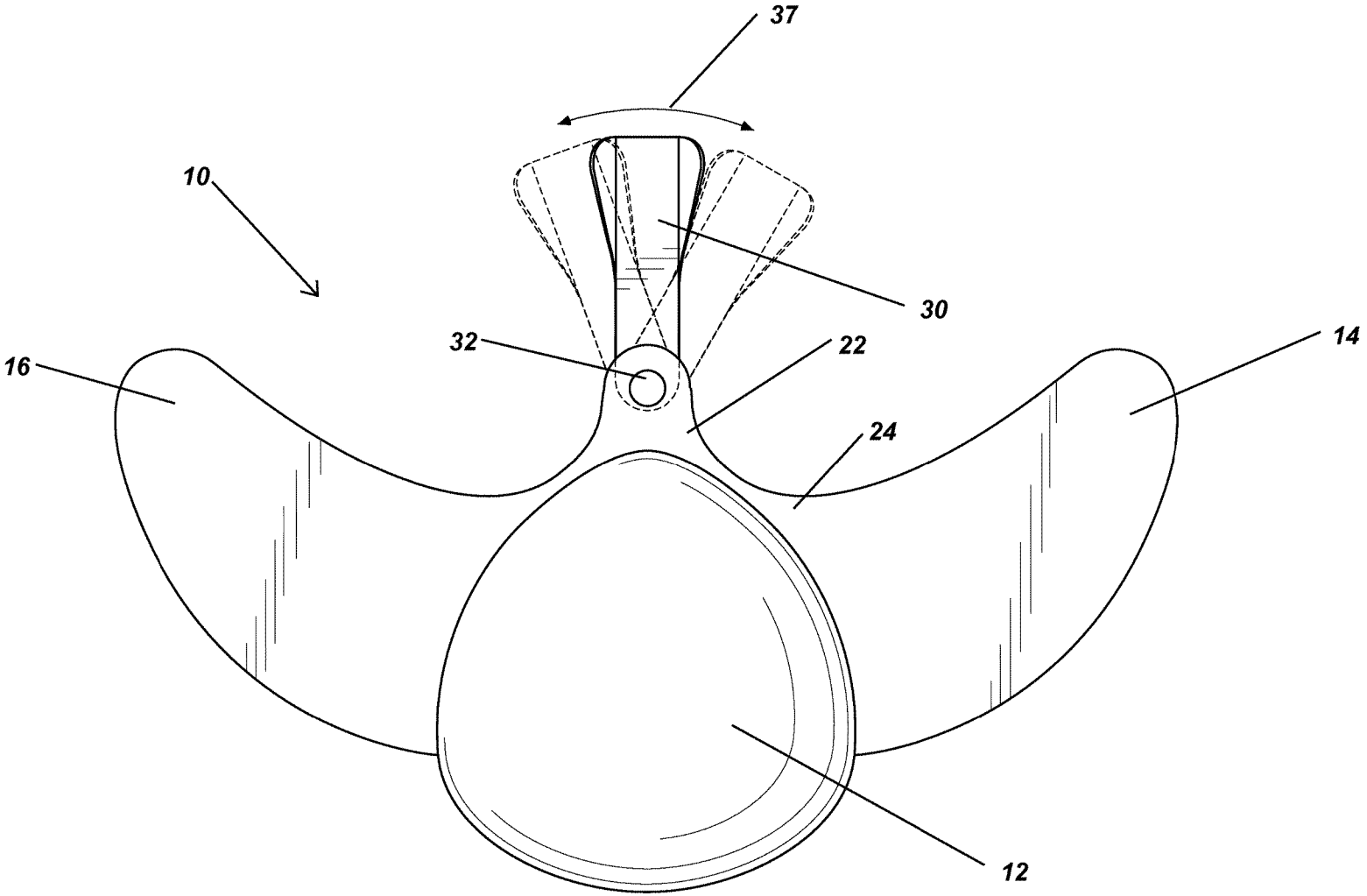
FIG. 2 illustrates a top view of the system of FIG. 1.
Figure 3:
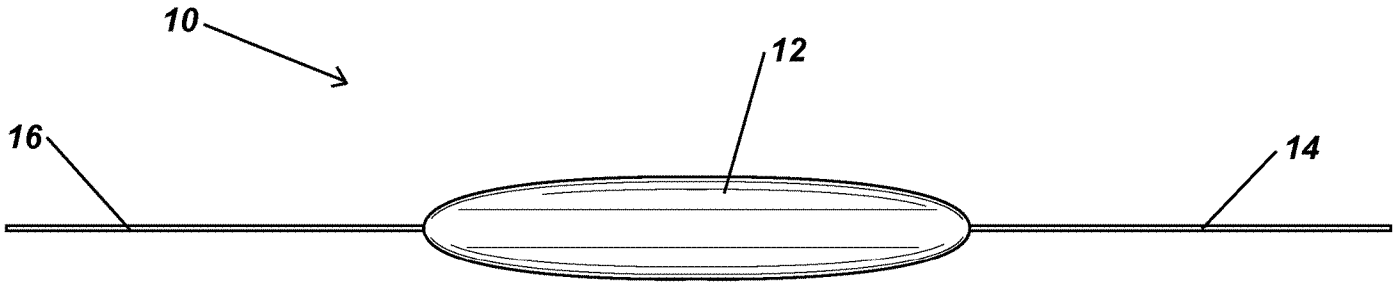
FIG. 3 illustrates a front view of the system of FIG. 1.

The device 10 may also be provided with a rudder 30. The rudder 30 may be pivotably connected to the third wing or protrusion 22 such that the rudder may be rotated in the same plane as the wings and used to aid the glide and direction of glide of the device 10 through water. The rudder 30 may be attached in any suitable means, such as via a connector 32 described in more detail below. FIG. 2 shows a top view of the device 10 and the direction of the rotation of the rudder is indicated by the arrow 37. In other configurations, the rudder may be connected such that it does not rotate but is in a fixed position.

Alternatively, the wing assembly 24 may only include the first wing 14 and second wing 16. The rudder 30 may extend from the body 12 of the device 10. The rudder 30 may be secured to the body 12 in a similar manner as previously described with the rudder 30 coupled to the third wing 22.

Figure 4:
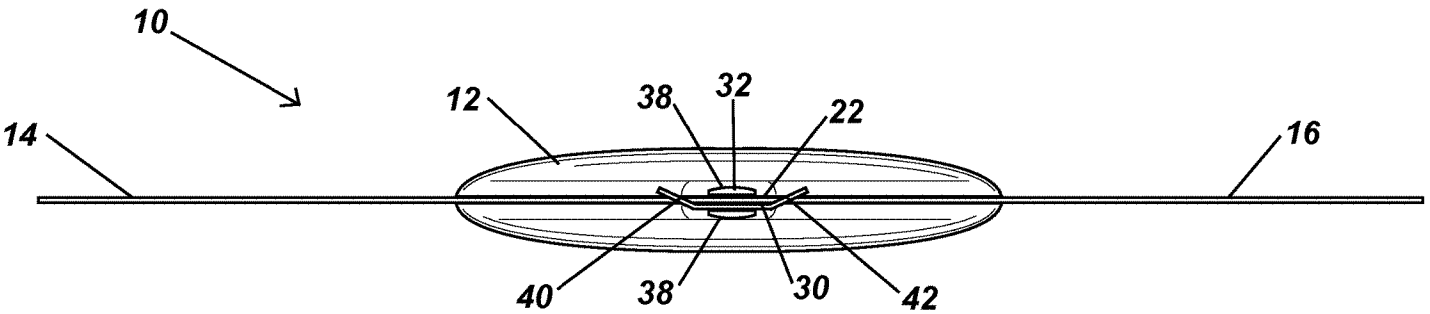
FIG. 4 illustrates a back view of the system of FIG. 1.

The rudder may comprise a proximal end 34 connected to the third wing 22, and a distal end 36. The rudder may be generally flat and extend in the same plane, or a parallel plane, as the first wing 14, second wing 16, and third wing 22. In other words, the position of the rudder 30, when engaged with the third wing 22, may be substantially parallel, in a planar fashion, to the wings 14, 16. The rudder 30 may also include lateral projections or fins 40, 42 at the distal end 36. The distal lateral projections or fins 40, 42 may be non-parallel. For example, the fins 40, 42 may extend upwardly from the plane of the rudder and wings. FIG. 4 shows a rear view of the device 10, with the fins 40, 42 projecting generally upwardly from the plane of the rudder 30. The rudder 30 of this configuration may be made of a single piece of material, or two or more pieces secured together (for example, a flat piece forming the flat parallel portion secured to two fin pieces in any manner described herein). The rudder 30 may be various shapes and sizes, including various lengths, widths, and shapes and sizes of the lateral projections or fins 40, 42. Additionally, the fins 40, 42 may project upwardly at varying angles from the plane of the rudder 30. Lateral projections or fins 40, 42 that project upwardly may assist to guide the movement of the device 10 in the water by improving the ability to steer or stabilize the forward movement of the device in water or air. For example, the rudder 30 with fins 40, 42, may be used to counter adverse yaw and also be used to turn the device in water.

Figure 5:
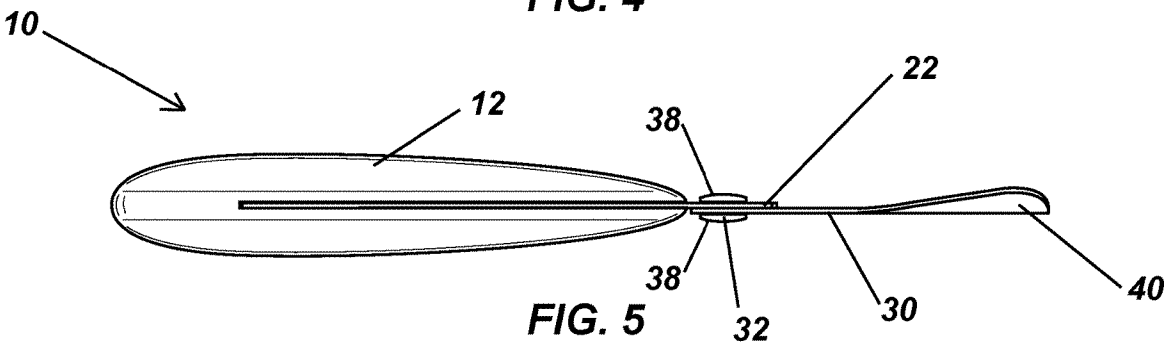
FIG. 5 illustrates a side view of the system of FIG. 1.
Figure 6:
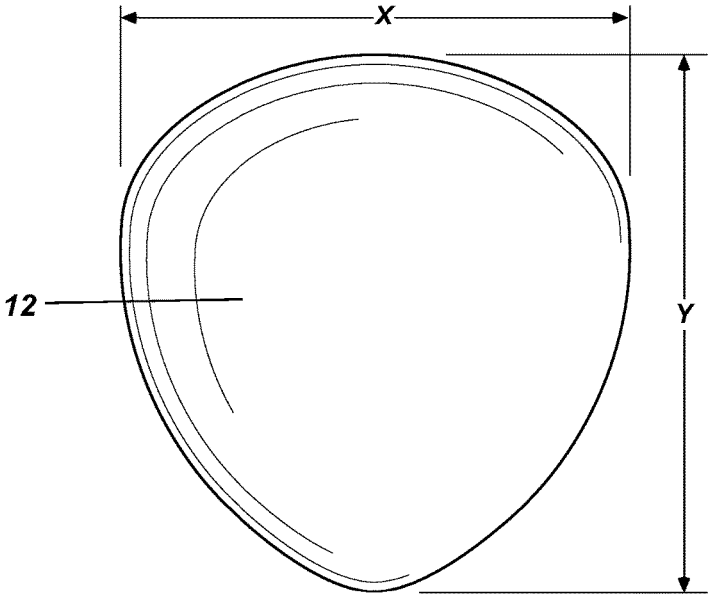
FIG. 6 illustrates a top view of the body of the system or device of FIG. 1.

As can be seen in the rear view shown in FIG. 4, the fins 40, 42 may extend upwardly at an angle of approximately 30 degrees from the angle of the rudder 30. This angle is shown by way of example and not of limitation, and it will be appreciated that other suitable angles may be used, such as angles ranging from 10 degrees to 80 degrees. The rudder may be any length desired. As can be seen in the side view of the device 10 shown in FIG. 5, the length of the rudder may be about ⅔ the length of the body 12. A longer rudder may slow the rise of the device 10 in the water. For example, with a longer rudder, the device may travel slowly enough in water for children (who generally do not move very fast in water) to follow the device as it travels through the water and aid in playing games with the device.

The rudder 30 may be fixedly or may be pivotably mounted at its proximal end 34 to the third wing 22. Any suitable means can be used to pivotably mount or rotatably connect the rudder 30 to the third wing 22, for example, an aperture 46 may extend through the third wing 22 (see FIG. 11). The proximal end 34 of the rudder 30 may similarly include an aperture that extends through the rudder 30. The aperture of the rudder 30 and the aperture 46 of the third wing 22 may align. A connector 32 may be used, such as a connector with a pin or other axis that can be rotated around, that may be passed through the aperture of the rudder 30 and through the aperture 46 of the third wing 22. The connector 32 may also include one or more shoulders or cover members 38 at the top or proximal end of the connector 32 and bottom or distal end of the connector. The cover members may be of sufficient diameter to cover the apertures of the third wing 22 and rudder 30 to prevent the connector 32 from being removed. In one configuration, the connector 32 may be formed from two pieces, each having a pin portion and a cover member, with the pin portions passed through the apertures and connected (such as snap-fitted or frictionally fitted or glued together). The connector may also be formed of two pieces, one having the full pin portion and a cover member, the pin portion passed through the apertures, and then connected to a cover member to prevent the pin portion from being removed.

The connector 32 may also include barbs or flanges (such as circumferential flanges) that once passed through the apertures prevent the connector 32 from pulling back through because the barbs are biased against the outside edge of the apertures. The space between the barbs and the cover member may be sufficient to fit the rudder 30 and the third wing 22 while providing a press or other secure fit such that the rudder 30 is rotatable but only through significant pressure or force to rotate the rudder 30 from one position to another. Under this embodiment the rudder 30 may rotate to an infinite number of positions.

In some configurations, the rudder 30 may be capable of being rotated but only with a substantial application of force. The aperture may comprise notches with complementary ridges or barbs on the pin portion of the connector 32 that allow the connector 32 to be rotated and stopped in each respective notch. It will be appreciated that the notches and ridges may be interchanged between the connector and the aperture. The connector 32 may also comprise a shoulder at the top and bottom to prevent the connector from slipping out of the apertures. In some configurations the pin may be comprised of a first portion with a shoulder that snap-fits or pressedly fits together with a second portion with a shoulder.

The rudder 30 may also include a distal end 36 that has a wider profile than the proximal end 34. The wider distal end 36 of the rudder 30 may provide drag on the device 10 allowing a user to manipulate the trajectory of the device 10 by rotating the rudder 30 in a harmonizing position. The device 10 may still glide in a manner as previously disclosed herein ascending at a 10:1 ratio to a 15:1 ratio, however, depending on the position of the rudder 30 the device 10 may have a curved, circular or similar trajectory if the rudder 30 is rotated in a specific position such that the drag on the rudder 30 causes the device to turn or curve. If the rudder 30 is positioned such that the rudder 30 is linear with a central axis of the device 10, the device 10 will glide in a substantially straight, forward manner as though the rudder were not engaged at all. The steering of the device 10 may thus be intuitive and effective to aid in using the device for recreation, particularly for children.

The body 12 may be comprised of a buoyant material such as foam or foam-like material (a lighter than water material) which has the tendency to rise in water. Those materials include, but are not limited to, ethyl-vinyl acetate, polyurethane, or #4 or #5 high density Styrofoam. The device 10 may also be formed of recyclable materials. While each of these different materials may allow for printable graphics on the body 12 of the device 10 it will be appreciated that a polystyrene may also be utilized with a #6 density to #8 density. Anything above a #6 density may provide the easiest transfer of a printable graphic on to the body. Printing a graphic onto the body 12 may be performed in a number of different ways including that outlined in U.S. Pat. No. 4,436,571. Another, similar method, as described from internet resources provides the following: "In the process, the substrate piece to be printed first goes through the entire painting process: surface preparation, priming, painting, and clear coating [an unnecessary step to the current disclosure, but may still be utilized]. After painting but before clear coating, the part is ready to be processed [again an unnecessary step for the current disclosure, but may still be utilized]. A polyvinyl alcohol hydrographic film, which has been gravure-printed with the graphic image to be transferred, is carefully placed on the water's surface in the dipping tank. The clear film is water soluble, and dissolves after applying an activator solution. Once dipping is begun, the surface tension of the water will allow the pattern to curve around any shape. Any remaining residue is then rinsed off thoroughly. The ink has already adhered and will not wash off. It is then allowed to dry. The adhesion is a result of the chemical components of the activator softening the base coat layer and allowing the ink to form a bond with it. One of the most common causes of a failure to achieve adhesion between the two layers is a poorly applied activator. This can be either too much activator being applied or too little. Quality activator is one of the most important elements in producing a high quality, professional Hydrographic transfer." (www.liquidprintone.com) Any of these processes may hereinafter be termed "hydrographic printing" or "hydro-printing."

If a lower density foam, such as Styrofoam or polymer is used to form the body, it may be required to pre-paint the body 12. While this process is achievable it may take more time and be more costly.

The guitar pick shape of the body 12 may have its thicker portion nearer the proximal, or front end 18 of the body 12 to position its center of gravity and buoyancy further toward the front of the device 10 to further encourage the front end 18 of the device 10 to rise in water. The position and size of the wings 14, 16 relative to the center of gravity of the body 12 determine the angle of rise of the device 10 as it rises in water. That is, when the device 10 is submerged in water and released, the front end 18 of the device 10 will tend to rise. The wings 14, 16 try to force the device 10 in a horizontal path in line with a plane defined by the upper surface of the wings 14, 16. Because of the aerodynamic or hydrodynamic shape of the body 12 and the lack of resistance to forward movement of the wings 14, 16, the vehicle or device 10 will rapidly glide in a forward direction while gradually ascending to the surface. Indeed, enough speed can be generated by the device 10 that the device 10 can actually leap out of a body of water, such as a swimming pool, and fly onto an embankment.

The wings 14, 16 may have other shapes, such as a more gradually tapered shape. Additionally, the wings, especially the back side of the wings, may be provided with various shapes for either functionality or aesthetic purposes. For example, a wavy design may be cut at the rear edge of the wings or a bat-wing like design may be cut at the rear edge of the wings. The wings 14, 16 may be positioned nearer the distal or back end 20 of the body 12 to position the center of buoyancy nearer the front of the vehicle or device 10, and thus control the rate of ascension in water. The body 12 is generally wider and thicker proximate the front or leading end 18 of the device 10 and includes a tapered front end 18 and a tapered back end 20. The wings 14, 16 are generally thin and flat and are preferably secured to the body 12 at a position behind the center of gravity of the body 12. That is, the center of gravity of the wings (or more precisely the axis of rotation of the wings) is positioned behind the center of buoyancy of the body 12 so that, in water, the center of buoyancy of the vehicle or device 10 is positioned in front of the center of gravity of the wings to cause body 12 to tilt upward and glide at a shallow angle in a forward direction.

Alternatively, the body 12 may be more bulbous on the downward facing side. If the downward facing side of the body is more bulbous then the glide pattern tends to be more gradual. The more bulbous the body 12 can have a more bulbous side facing upward and in this instance the glide pattern may be less gradual than when the bulbous side is facing downward. It will be appreciated that the device 10 may function and glide regardless of which side is facing down or up.

The wings 14, 16 may be tapered and may sweep toward the distal or back end 20 of the body 12 of the device 10. The wings 14, 16 keep the device 10 from rising at too steep of an angle and further stabilize the device 10. The swept wing configuration encourages the device 10 to travel in a relatively straight path in the direction of the front end 18 of the device 10. In addition, because the wings are relatively thin and flat, the wings 14, 16 have a very low coefficient of drag thus allowing the vehicle to travel at relatively high horizontal rates of speed under water. Because the body 12 is made from a lighter than water material, the front end 18 of the device 10 is encouraged to rise in the water propelling the device 10 forward, in a 10:1 or greater (i.e. 15:1) ratio of horizontal motion to vertical motion, without the use of other propulsion methods. The wings 14, 16 may be comprised of a lighter than water material but may be more rigid than the body 12; and the wings 14, 16 may include materials such as Formica, nylon, other plastics or polymers allowing the wings 14, 16 to flex without folding.

The device 10 can glide under water in a direction which is slightly upward from a plane defined by the top surfaces of the wings 14, 16 or the midline of the body 12. In use for recreational purposes as in a swimming pool, the device 10 is submerged by a user, aimed in a desired direction and released. The device 10 upon release will travel or glide at a relatively rapid rate in a forward direction while relatively gradually rising to the surface of the water. That is, because of the location of the center of buoyancy being at a position forward of the center of the wings, the body will tend to rise in water in a forward direction.

Figure 7:
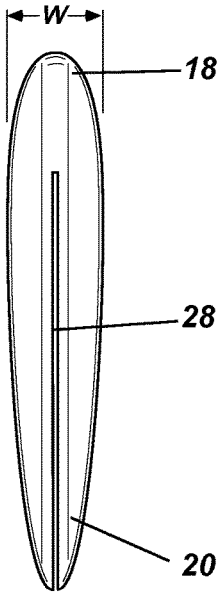
FIG. 7 illustrates a side view of the body shown in FIG. 6.
Figure 8:
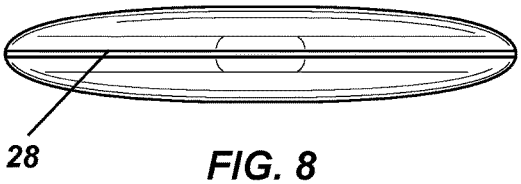
FIG. 8 illustrates a rear view of the body shown in FIG. 6.
Figure 9:
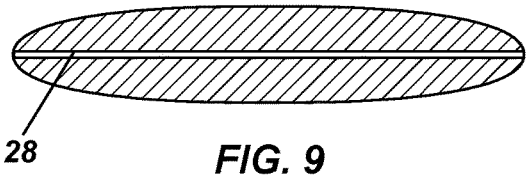
FIG. 9 illustrates a rear, cross-sectional view of the body shown in FIG. 8.
Figure 10:
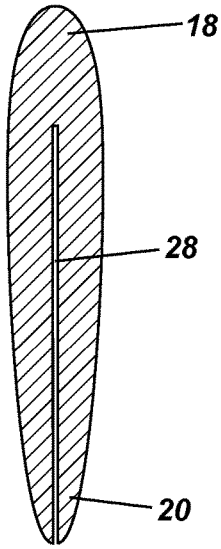
FIG. 10 illustrates a side, cross-sectional view of the body shown in FIG. 7.
Figure 12:
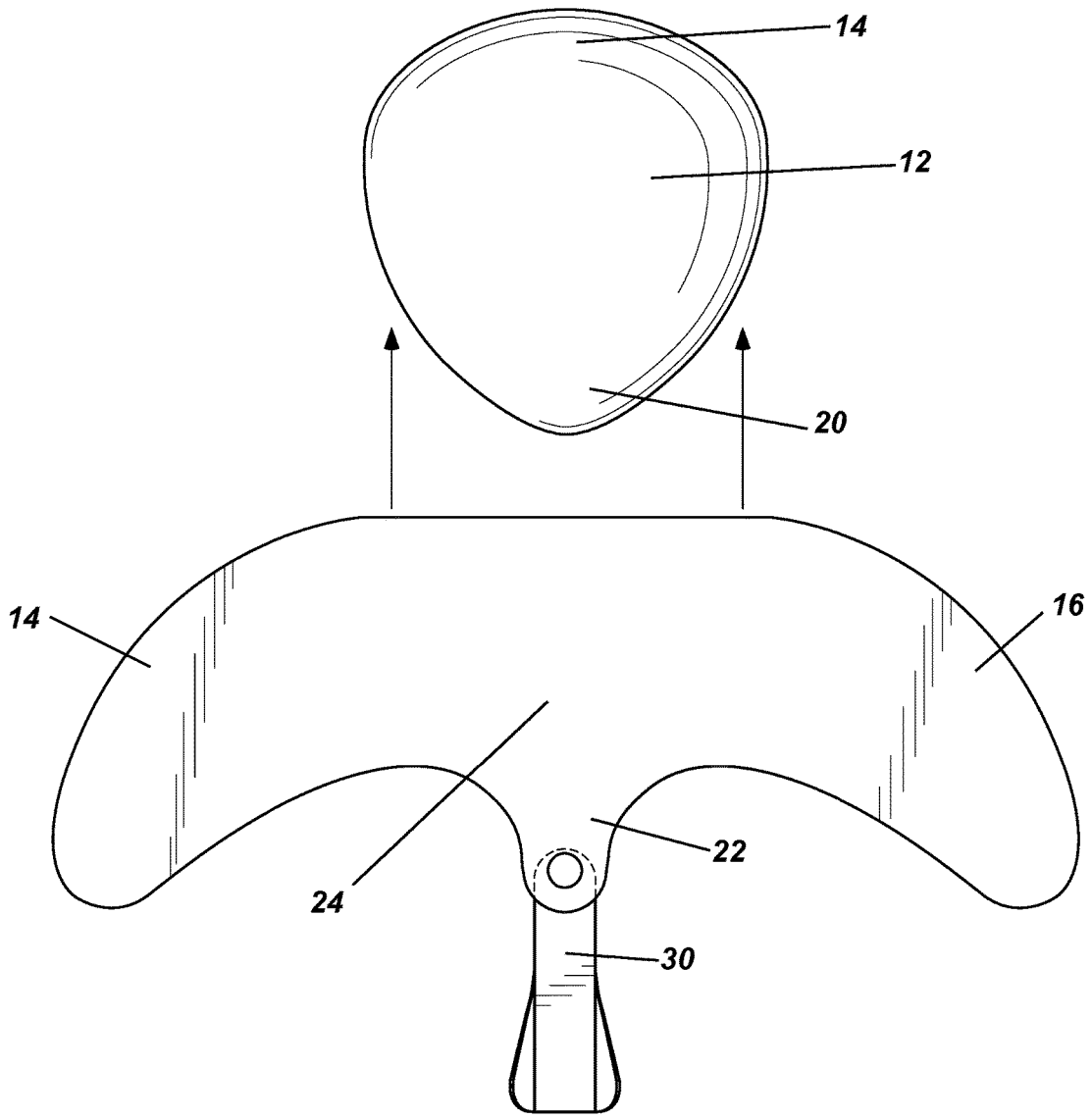
FIG. 12 illustrates an exploded view of the system or device shown in FIG. 1, with the wing assembly attached to the rudder.

The wing assembly 24 may be attached to the body 12, for example, by inserting the wing assembly 24 through a channel 28 transversely extending through the body of the device from the back end 20 of the body 12 towards the front end 18. FIG. 8 shows a rear view of the body 12 with the channel 28. Similarly, FIG. 7 shows a side view of the body 12 of the device with the channel 28 open at the back end 20 of the body and extending transversely through the body 12. FIG. 12 shows a top view of the body 12, with the wing assembly 24 and rudder 30 attached by moving the wing assembly 24 and rudder into the transverse channel 28 in the direction of the arrows The wing assembly 24 may be comprised of a polymer with a single thickness, or with a varying thickness, with a thinner polymer towards the center.

An alternate embodiment may be a first wing 14 separate from a second wing 16 and third wing 22 that can be secured together via tape (which may be waterproof) or other means of securement including glue and welding. Other methods of securing the first wing 14 and second wing 16 together with the third wing 22 may include a channel in either wing inside of a receiving receptacle in the opposing wing; a male/female attachment method; a press fit method; a snap fit method or any other permanent or removable medium for securing two planar objects together while still maintaining the rigidity of the two wings for its purposes outlined in this disclosure. Although the wings 14, 16 may be separate they would still be engaged to the body 12 in a manner similar to the single elongate member design as described herein.

The wing assembly 24 may slide into a transverse channel 28 cut into the body 12 of the device 10 at the back end 20. To prevent the wing assembly 24 from withdrawing from the body 12 the wing assembly may be glued, with a waterproof glue (for example, 3M fastbond contact adhesive 30-NF), within the body 12, the wing may be taped, with a waterproof tape, within the body 12 or the wing assembly 24 may be secured within the body 12 via press fit. Alternatively the wing assembly 24 may include spring biased snap features that when pressed may slide into the transverse cut and spring into place within a hole or receiving portion within the transverse cut of the body 12 of the device 10.

Alternate configurations of the body 12 may include a circular or disc shaped body with tapering ends around the circumference of the body. The tapering may be substantially similar to the previous embodiment, guitar pick like design or a Reuleaux triangle. Other alternate body shapes may include elliptical or ovular shape from a top view and circular or cylindrical shape from a front or back view. The wings may be shaped differently as well and may be more gradually or more sharply tapered toward a lateral end of the wings. Furthermore, the wings may include bends or curves (form a top profile) as the wings extend from the body. The wings may generally maintain a flat, planar, straight configuration.

Assembly of the device 10, as well as graphic printing may take place in a specified order; however, the order can be manipulated and changed as well for ease in manufacturing. After the body 12 is shaped to the desired dimensions the body 12 may undergo hydrographic printing with the desired graphics. Once the graphics have been printed onto the body 12 the body and the wings 14, 16 may be secured or attached, either as a single wing, or a double wings as previously described herein. The third wing 22 may be secured or attached to the body 12 as well in a like manner as previously described as well as the rudder 30 if the device requires the rudder 30. Based on the previously described embodiment in U.S. Pat. No. 6,328,622, a rudder may not be required. Assembly of the device of U.S. Pat. No. 6,328,622 may be similar after going through the hydrographic printing process.

Alternatively the device 10 may be entirely assembled prior to undergoing the hydrographic printing process. Likewise, the devices may undergo partial assembly prior to undergoing the hydrographic printing process. The process is intended to be a quick flowing high through-put process that allows for ease in manufacturability and low cost.

While the device may vary as described herein, any variation of the above embodiments may be combined or alternated and have been conceived and contemplated and fall within the scope of the device. Furthermore, the device is scalable and it is contemplated that the device may be vastly used any many aquatic or air environments including having a size that may carry people, animals or cargo that may fit within the body or on top of the body of the device. When a larger body is required a more robust material may be required to be used besides Styrofoam and perhaps a stronger polymer or even carbon fiber.

When contemplated as a toy the dimensions of the device 10 may vary greatly. From a top perspective the body may be from 8.89 cm to 24.13 cm (3.5 to 9.5 inches) from the front end 18 to the back end 20. From a top perspective the body may be from 7.94 cm to 21.59 cm (3.125 to 8.5 inches) from one lateral side of the body to the opposing lateral side. The wing span from the tip of the first wing 14 to the second wing 16 may be 21.59 cm to 57.15 (8.5 to 22.5 inches) in length. The rudder 30 will vary depending on the size of the body 12 and the wings 14, 16, but in some configurations the rudder may be from 5.08 cm to 12.1 cm (2 inches to 4.75 inches). These dimensions are purely for illustrative purposes and any dimensions that may perform the function of the device are within the spirit of the device are contemplated herein.

It will also be appreciated that while functioning as a toy, the device 10 may also be used as a tool to teach children principles of physics, such as Archimedes' principle, basic Newtonian physics, glide movement in water, and other general physics principles. The device 10 may also aid in teaching swimming, as it may encourage children to put their heads in the water (an important and often difficult step in introductory swimming).

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

The product can be developed as an autonomous underwater vehicle that runs solely on thermoclines (as does the Slocum Glider, but with a much larger glide ratio).

What is claimed:

1. A system, comprising:

a hydrodynamic body having a density less than water, a wing assembly separate from the body and coupled to the body, the wing assembly comprising;

an aperture extending through a portion of the wing assembly, wherein the aperture comprises at least one notch;

wherein the wing assembly extends in a first plane; and a rudder extending from and coupled to the wing assembly, wherein the rudder extends in a plane parallel to the first plane; wherein the rudder pivotally couples to the wing assembly.

2. The system of claim 1, wherein the wing assembly comprises a first wing extending laterally from the body and a second wing extending laterally from the body and opposite the first wing.

3. The system of claim 2, wherein the wing assembly comprises a third wing extending distally from the body, wherein the rudder extends in the first plane that the wing assembly extends.

4. The system of claim 3, wherein the rudder is configured to rotate in a plane parallel to the wing assembly.

5. The system of claim 1, wherein the rudder comprises a proximal end, the proximal end coupled to a third wing, and a distal end, the distal end being wider than the proximal end.

6. The system of claim 5, wherein the distal end of the rudder comprises one or more fins.

7. The system of claim 6, wherein the fins of the distal end of the rudder extend laterally and upwardly from the plane of the rudder.

8. The system of claim 6, wherein the rudder is formed from a single piece of material.

9. The system of claim 1, wherein the wing assembly is formed from a single piece of material.

10. The system of claim 9, wherein the body comprises a transverse channel cut partially through the body, and wherein the wing assembly is configured to attach to the body by engaging the wing assembly with the transverse channel.

11. The system of claim 1, wherein the body comprises a disk-like shape.

12. The system of claim 9, wherein a disc-like shape is one of an ovular shape, a Reuleaux triangle, and a circular shape.

13. A system capable of gliding in water or air, comprising:

a hydrodynamic body having a density less than water, a wing assembly coupled to the body, the wing assembly comprising a single continual piece of material separate from the body, the wing assembly comprising;

a first wing extending laterally from the body, a second wing extending laterally from the body and opposite the first wing, and a third wing extending distally from the body, the third wing having a first aperture therethrough;

wherein the wing assembly extends in a first plane; and a rudder extending from and pivotably coupled to the third wing, the rudder having a proximal end and a distal end, the proximal end having a second aperture therethrough in alignment with the first aperture of the third wing, and a connector extending through the first aperture and the second aperture;

wherein the rudder extends in a plane parallel to the first plane and is configured to rotate in plane parallel to the first plane, and wherein the rudder comprises one or more fins.

14. The system of claim 13, wherein the first wing, second wing, and third wing are formed from a single piece of material.

15. The system of claim 14, wherein the body comprises a front end and a back end, and wherein a transverse channel is cut partially through the body from the back end towards the front end.

16. The system of claim 15, wherein the wing assembly is configured to attach to the body by sliding the wing assembly into the transverse channel.

17. A system capable of gliding in water or air, comprising:

a hydrodynamic body having a density less than water, a wing assembly separate from but coupled to the body through a transverse channel cut partially through the body from the back end towards the front end, the wing assembly comprising;

a first wing extending laterally from the body, a second wing extending laterally from the body and opposite the first wing;

wherein the wing assembly extends in a first plane; and a rudder extending from a third wing, the rudder having a proximal end and a distal end, wherein the rudder extends in a plane parallel to the first plane, wherein the rudder is pivotally coupled to the third wing.

18. The system of claim 17, wherein the rudder is configured to rotate in a plane parallel to the wing assembly.

19. The system of claim 17, wherein the rudder comprises a proximal end, the proximal end coupled to the third wing, and a distal end, the distal end comprising one or more fins.

20. The system of claim 17, an first aperture passing through the third wing, the first aperture comprising notches;

a second aperture passing through the rudder, the second aperture comprising notches; and a pin passing through the first and second apertures, the pin comprising complementary ridges;

wherein the complementary ridges and notches of the first and second apertures allow the rudder to be rotated into a reversibly stopped position.

* * * * *